US006129889A

United States Patent [19]

Slamenik et al.

[11] Patent Number: 6,129,889

[45] Date of Patent: Oct. 10, 2000

[54] GAS-FLUSHING BASE FOR METALLURGICAL VESSELS

[75] Inventors: Manfred Slamenik, Trofaiach; Franz Reiterer; Walter Hammerer, both of Leoben, all of Austria; Karl-Heinz Dott, Taunusstein, Germany; Klaus Dosinger, Leoben, Austria; Michael Heiligenbrunner, Vienna, Austria

[73] Assignee: Veitsch-Radex Aktiengesellschaft fur Feuerfeste Erzeugnisse, Vienna, Austria

[21] Appl. No.: 09/117,697

[22] PCT Filed: Jan. 30, 1997

[86] PCT No.: PCT/EP97/00406

§ 371 Date: Nov. 16, 1998

§ 102(e) Date: Nov. 16, 1998

[87] PCT Pub. No.: WO97/28915

PCT Pub. Date: Aug. 14, 1997

[30] Foreign Application Priority Data

Feb. 7, 1996 [GB] United Kingdom ..... 196 04 413

[51] Int. Cl.[7] ..... C21C 7/072

[52] U.S. Cl. ..... 266/220; 266/216

[58] Field of Search ..... 266/216, 217, 266/220

[56] References Cited

U.S. PATENT DOCUMENTS 5,225,143 7/1993 Labate II, et al. ..... 266/220

5,423,521 6/1995 Stover et al. ..... 266/220

*Primary Examiner*—Scott Kastler

*Attorney, Agent, or Firm*—John F. A. Earley; John F. A. Earley, III; Harding, Earley, Follmer & Frailey

[57] ABSTRACT

The invention concerns a gas purging bottom for metallurgical vessels, the gas purging bottom comprising a monolithic refractory ceramic lining having channels formed therein by chemical or physical processes. At their ends associated with an adjacent vessel wall, the channels are designed for direct or indirect fluid connection to a gas supply pipe. At their other ends the channels lead into the corresponding outer layer of the refractory ceramic lining.

30 Claims, 3 Drawing Sheets

FIG. 3
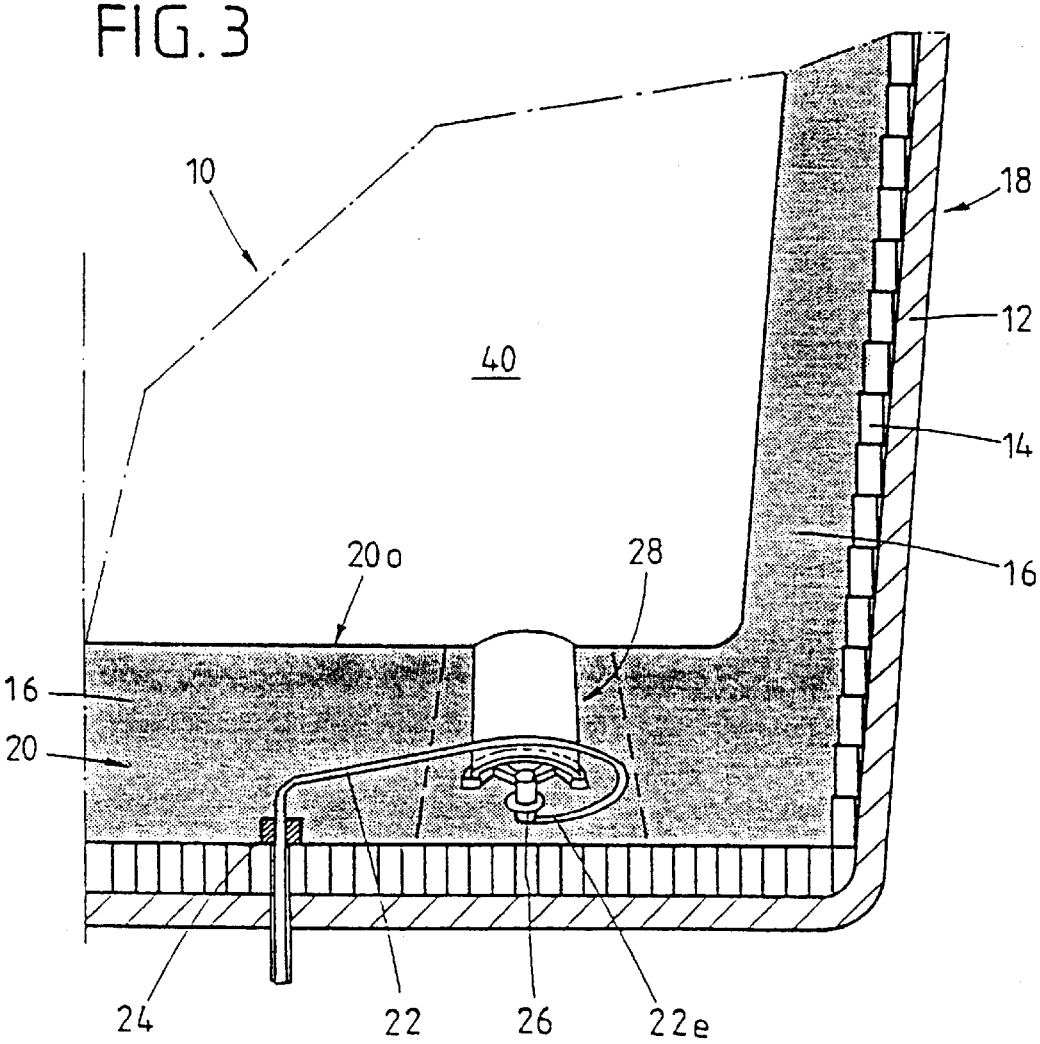
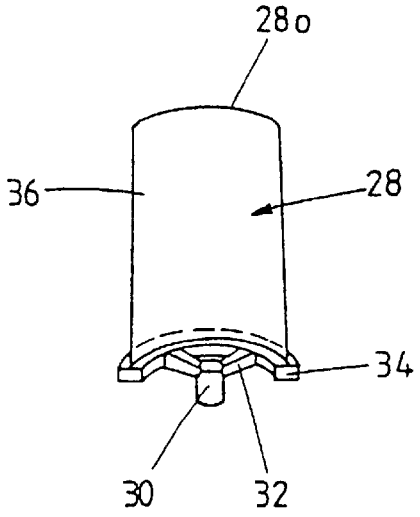
FIG. 4

GAS-FLUSHING BASE FOR METALLURGICAL VESSELS

DESCRIPTION

The invention concerns a gas purging bottom for metallurgical vessels, particularly for the steel production.

In the field of metallurgy, there are numerous systems for introducing gases (possibly in combination with pulverized solids) into molten baths.

So-called gas purging plugs in the form of discrete gas purging elements are known. These are embedded into the wall or the bottom of a metallurgical vessel (ladle, tundish, converter, evacuation vessel, etc.). There are various structural shapes: having directed or undirected porosity (for example EP 0 521 371 B1), so-called gas purging plugs with slitlike channels, so-called gas purging plugs with crossed channels (for example DE 37 27 938 C1), etc.

Furthermore, gas purging devices are part of the prior art, which are integral components of a bottom or a wall of a metallurgical vessel.

According to AT 398 632 B, rodlike bodies are embedded into the refractory hearth building material in the region of the gas outlet openings of a gas distribution chamber at the bottom, which consist of a porous material or of a material, the thermal expansion behaviour of which is different from that of the hearth building material so that in operation (with corresponding heating) "expansion cracks" or "slits" occur along which the gas may flow. Disadvantageous is that the gas flow quantity can only be controlled with difficulties.

Also DE 37 42 861 C1 describes a type of a gas purging bottom, according to which gas is conducted through a porous refractory lining. Here too, controlling the gas flow along the bottom having an undirected porosity is at most empirically possible.

The invention further develops the basic idea of the above-mentioned state of the art (formation of a gas purging device as an integral component of a refractory lining of a metallurgical vessel) and provides a gas purging bottom for metallurgical vessels, having a directed porosity, which is formed within a portion of or the whole refractory lining of the vessel. Preferably the directed porosity (in the form of channels, slits or the like) is to be formed in situ within the refractory lining and at the same time to be in fluid connection to a gas supply pipe, in order to be able to introduce purposefully and reproduceably a controllable gas quantity into a molten metal bath over a purposefully adjustable area with an exactly predeterminable pressure.

With that the following modifications and new possibilities, compared to the state of the art mentioned at the beginning, may be provided:

The bottom or the wall of the metallurgical vessel can be formed in situ (externally or on site) with a gas purging device.

The type and size of the gas purging device may be varied nearly arbitrarily.

The area over which gas is injected into the molten bath may be adjusted as well as the quantity of the gas.

The refractory lining, including the gas purging device, may be prefabricated totally or partly as prefabricated part (s).

The type of the directed porosity (slits, cylinder, etc.) is adjustable arbitrarily.

Upon war, a partial repair is possible.

A gas distribution chamber may be formed as component of the refractory lining or outside the said lining (for example as part of the metallic casing of a metallurgical vessel).

A constant purging cross section may be achieved by a special geometry of the purging regions formed within the refractory material, even with advanced erosion of the refractory material.

In its most general embodiment, the invention concerns a gas purging bottom for metallurgical vessels having a monolithic refractory ceramic lining, having channels formed therein by chemical or physical processes, which channels are formed at their end related to an adjacent bottom of the vessel for direct or indirect fluid connection to a gas supply pipe and terminate at their other end within the corresponding outer layer of the refractory ceramic lining.

Here, the term "channel" is to be understood in its most general meaning, which is not limited in its geometry, thus includes tubelike, slitlike, ring channel-like, netlike channels or channels formed like steps, among others.

The channels may be formed by chemical or physical processes. Above all, there are included: the melting out or the burning out of corresponding inserts (having a shape corresponding to the course of the channels) of appropriate materials, but, for example, the forming of the channels by laser technique (laser cutting) as well.

Accordingly, the inserts may consist of fibrous, tubelike, sheetlike, netlike or steplike elements which are mixed or inserted into a refractory ceramic mass during or after the production of the said lining.

The inserts may be distributed regularly or irregularly within the ceramic mass. Considered over the cross section of the whole bottom of a metallurgical vessel—also zones having a different formation or distribution of the gas channels may be built. So, for example a larger number of purging channels may be provided in the center than in the side portion of the bottom.

The ceramic lining can be made of standard qualities and be gastight, because the gas permeability is achieved via the channels within the lining. This facilitates a good stability of the bottom.

The fluid connection of the gas supply pipe to the channels may be effected in different ways:

The gas supply pipe may be coupled directly to the end at the inlet of the channels. Such a form is used, for example, when the channels run from a common connection region. Such a connection is illustrated schematically in section in FIG. 1*a*.

The gas supply pipe, as a gastight supply pipe, may be conducted up to the upper end of a possible outer (permanent) lining of the metallurgical vessel. But as well it may be connected, for example, directly to the metal casing of the vessel or to a coupling part arranged at the bottom, for example, screwed thereto. Then, the passing on of the gas is effected, for example, via corresponding pipes within the outer lining to the channels of the monolithic (wear) lining of the bottom. This and other possible connections are shown in FIG. 1*b* through 1*e*.

A gas distribution member may be disposed between the end at the gas outlet of the gas supply pipe and the corresponding ends at the gas inlets of the channels, as illustrated schematically in section in FIG. 1*c* through 1*e*.

This distribution member as well may be formed—like the channels—by chemical and/or thermal reaction (decomposing/fusing) of a corresponding insert (FIG. 1*c*). It may as well consist of a stable material, for example metal (FIG. 1*d*).

If the insert consists of paper, cardboard, synthetic material or the like, a direct fluid connection to the gas supply may be obtained after eroding the insert by heat (the term "eroding by heat" meaning every way of removing the insert). With that the arrangement of separate gas distribution chambers is no longer necessary, although it is possible (FIG. 1*c* through 1*e*). The insert may also have openings so that first the refractory matrix material may penetrate it and later (after eroding the insert by heat) a labyrinth-like structure of the purging channel or channels is formed.

Of course, also gas purging bottoms of the kind of "gas purging plugs with slitlike channels" may be formed in the described manner.

With this slitlike channel geometry, above all, the purging slits serve the function of expansion joints within the monolithic refractory component and thus a useful additional function at the same time.

By a perforated, perforate, chequered or steplike formation of the corresponding inserts (having corresponding openings)—as illustrated schematically in FIG. 2 as elevation view—the following may be achieved:

The insert—oriented vertically—is cast-in with a refractory mass, over the whole height in fact. The hatchedly illustrated portions G1, G2 . . . Gn consist of a heat-erodable synthetic material, the intermediate portions are recesses of the insert, which are filled correspondingly with refractory material. The fields G1 at the bottom are placed onto a raillike end S of a gas supply pipe L which provides, after eroding the hatched fields G1, G2 . . . Gn by heat, a continuous gas flow from the end of the gas supply pipe into the molten metal view the portions G1, G2, . . . Gn, the gas flowing in succession through the areas G1.2, G2.3, G3.2 and Gn.3, for example. After removal of the insert connecting portions V provide a fluid connection between adjacent portions (for example G1.2-G2.3; G2.3-G3.2 etc). The cross-sectional area at the end at the gas outlet is defined by the portions Gn.1+Gn.2+Gn.3. If the purging bottom is worn up to the field row G3, a corresponding (unchanged) cross-sectional area for the gas outlet, corresponding to the field row Gn, is available via the fields G2.1 through G2.3.

It is obvious that the same result may be achieved with modified geometrical shapes of the insert(s) as well, for example a stepped course of the fields/recesses.

The region of the connection of the gas supply pipe and channels may be effected on or within the refractory lining.

It may also be formed at the metallic outer casing of the metallurgical vessel, as illustrated schematically in FIG. 1*c, d.*

The connection of the channels to the gas supply pipe may be assisted by means (adapter) for attaching the insert(s) to the gas supply pipe. FIGS. 3 and 4 show examples of that.

Apart from the gas supply pipe (possibly including the said adapter) and the insert(s) possibly connectable thereto, no other parts are necessary for the formation of the purging gas line or the gas purging channels. Thus, the production is simplified. This is particularly true for gas purging devices wherein the refractory ceramic matrix material is cast onto or around the said parts. For that the gas supply pipe (possibly the adapter) and the insert(s) are positioned and then cast-in with the material, Alternatively, the inserts are mixed (distributed) with (within( the material and fabricated into a bottom or a wall (possibly a bottom or wall segment) and afterwards inserted into the metal casing of the metallurgical vessel, and the inserts (or already formed channels) are connected to the gas supply pipe.

The said adapter may be an integral component of the end at the gas outlet of the gas supply pipe. For example, it can consist of an external thread or a bayonet joint, the body correspondingly being screwed or pushed onto this end (the adapter).

The adapter may also be a separate component which is screwed (clamped) onto the end at the gas outlet of the gas supply pipe itself or is welded thereto. In this case, the adapter has anchoring means of the above-mentioned type for the body.

Especially if it is formed as a separate component the adapter, compared to the gas supply pipe, may have an increased cross section of flow (for the treating gas). Also it is possible to form the adapter having several gas outlet openings. Correspondingly, the body is then formed with a number of webs, each of which is associated to a gas outlet opening. Thus, after the eroding by heat, a plurality of individual gas channels is provided directly coming from the adapter.

The shape of the body (of the inserts) is almost arbitrary—as explained above. The bodies may be of a sheetlike, planar, netlike, cylindrical, parallelepidic, conical shape or have similar threedimensional geometries. The body portions may be connected to each other to facilitate the fabrication. Above all, the body preferably will be undivided at its joint with the adapter to facilitate a simple assembly. The description of FIGS. 3 and 4 will give further information to that.

From such a bottom part several webs may run, for example arranged radially, which extend in spaced apart or cross-linked relationship through the refractory casing.

In any case, the connection of one end of the body to the adapter (of the gas supply pipe) is maintained to provide, for example after eroding by heat, a direct fluid connection from the gas supply pipe into the purging channels then exposed.

In order to simplify the manufacturing and to guarantee the gas feed into the molten mass, the insert (the body), with its free end portion, may project beyond the (tight) refractory casing. In a purging bottom the body then (before eroding by heat or before withdrawal) projects into the interior of the metallurgical vessel. According to its function, a heat-erodable body will be destroyed upon heating the refractory lining or upon filling-in the molten bath. It is possible to cover the device (the body or possibly the whole purging bottom as well) with a porous refractory material.

With the design as a component of a refractory bottom (according to the invention, the term "bottom" includes also walls and parts or combinations of bottoms and walls) the described gas purging device may be replaced or repaired after wear of the refractory material. For example, the refractory material is broken off and afterwards a new body is put on and cast-in and/or enclosed within a refractory material. Thus the gas purging line and the adapter are reusable, only the insert and the worn refractory material are replaced.

The design makes the manufacturing of a gas purging bottom as a prefabricated part possible—as mentioned above. At the steel works, the worn bottom (including a purging device) may be replaced completely by a new bottom (including a purging device). Form closure elements at the edge facilitate the connection to adjacent components. Coupling parts at the side of the prefabricated part facing the bottom of the vessel facilitate the adjustment of the bottom during assembly. The idea of prefabricated parts can be expanded to complete refractory linings (wall and bottom) for metallurgical melting vessels.

The inserts may be formed with a very small cross-sectional area to minimize the risk of an infiltration of the molten bath. The channel width/channel diameter should be maximally 0,5 mm (when the purging bottom is in a cold state).

By a possible distribution of the gas purging channels over a large area (up to the total area of the bottom), a very favourable wear behaviour of such a purging bottom and a positive metallurgical effect are achieved.

Other features of the invention are given by the subclaims and the other application documents.

BRIEF DESCRIPTION OF THE DRAWINGS

FIG. 3 is a partial sectional view of a steel pouring ladle including a gas purging bottom.

FIG. 4 is a partial three-dimensional view of an insert.

The above-mentioned figures showing embodiments of the invention are described additionally in the following.

Figure 1A:
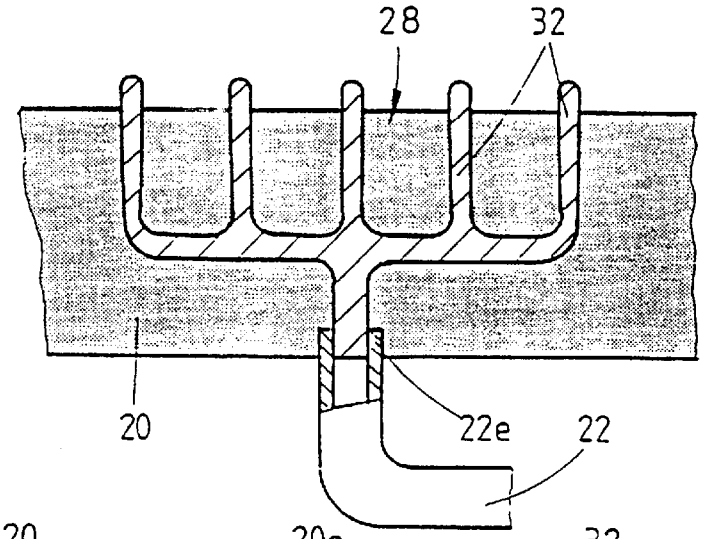
FIGS. 1*a*–1*e* schematically present three possible arrangements of a gas purging bottom in a sectional view.

FIG. 1*a* shows a gas supply pipe 22, into the free end of which a corresponding end of a body 28 of synthetic material is placed, which branches towards the opposite end in the form of numerous thin arms 32, similarly to a candlestick. After casting-in the body 28 (with the exception of the free ends of the arms 32 but including the end portion 22*e* of the gas supply pipe 22) with a refractory material 20 and eroding the body 28 by heat, a corresponding channel net is produced within the refractory lining, along which the gas is injected from the supply pipe 22 into the molten bath.

Figure 1B:
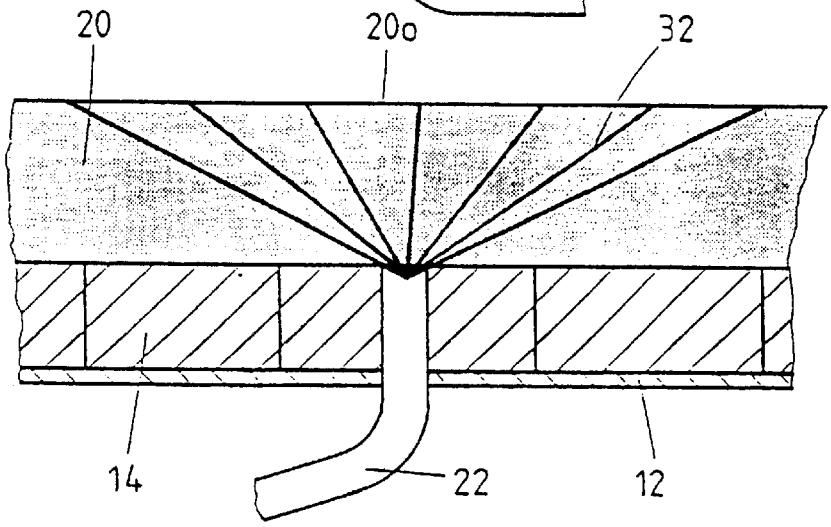

In FIG. 1*b*, the gas supply pipe 22 runs through the metallic casing 12 of a ladle and through an outer lining 14 of refractory ceramic bricks. Threadlike webs 32 of synthetic material are arranged within the monolithic ladle bottom 20, each of which having one end projecting into the open end of the pipe 22 and the other end running into the upper side 22*o* of the lining 20. After eroding by heat, a channel net corresponding to the course of the webs is produced in the refractory lining 20, which directly adjoins the pipe 22.

Figure 1C:
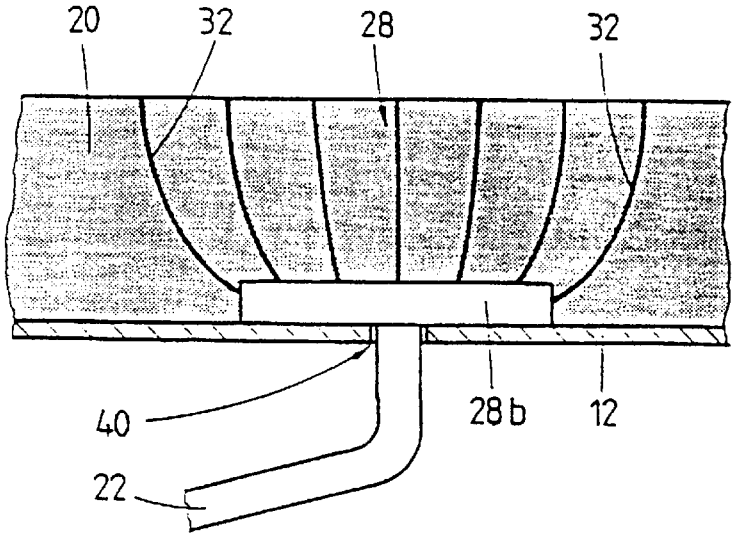

In the example of FIG. 1*c*, the free end of the gas supply pipe 22 is screwed into a bore 40 of the metal casing 12. Here, the bottom 20 is formed purely monolithicly (without outer lining at the wall) by covering a heat-erodable body 28 with a refractory mass. The body 28 consists of a platelike base part 28*b* and octopus-like thin arms 32 sticking out laterally and upwardly, which, after eroding by heat, form a gas distribution chamber in the region of the base part 28*b* and purging channels in the region of the arms 32. Accordingly, the gas flow is effected from the pipe 22 via the gas distribution chamber and the channels into the molten mass.

Figure 1D:
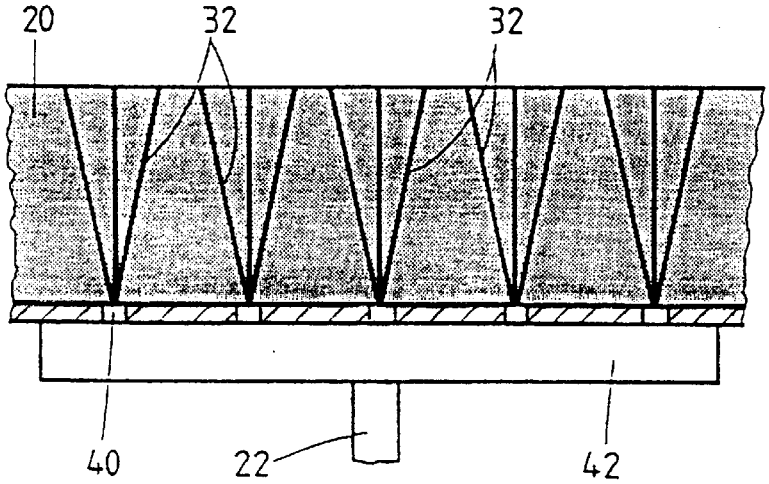

In the example of FIG. 1*d*, a metallic gas distribution chamber 42 is placed onto the metal casing 12 at the outside, which has openings 40 in that region, which the channels adjoin, which have been produced in the refractory material of the bottom 20 after eroding corresponding paper webs 32 by heat.

Figure 1E:
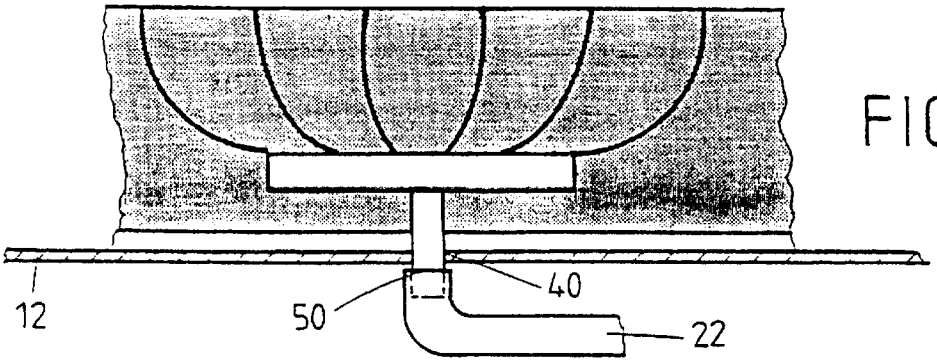
Figure 2:
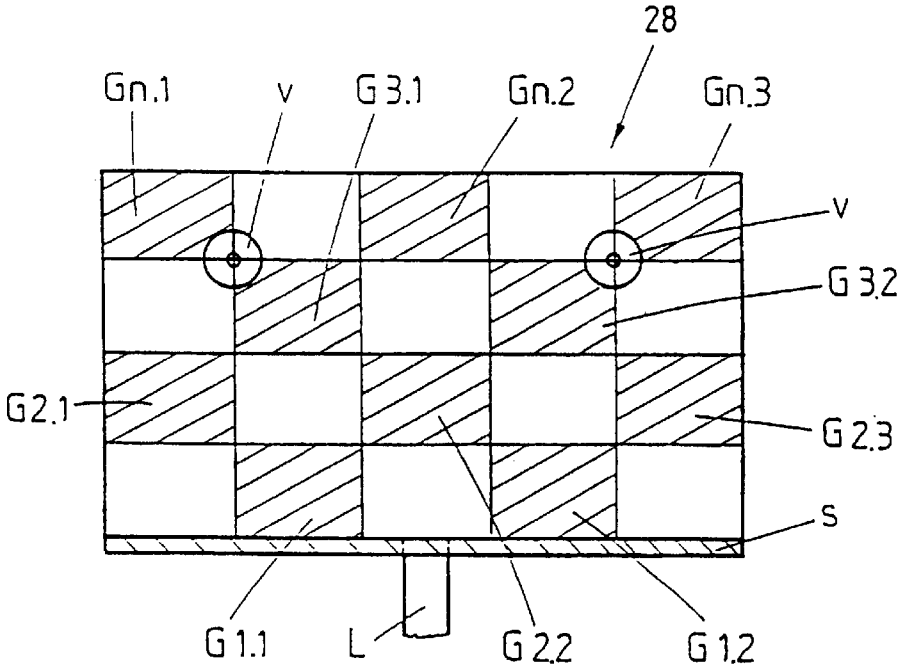
FIG. 2 is a view in elevation of a checkered formation of an insert.

In the embodiment of FIG. 1*e*, a metallic tubular coupling part 50 projects into the monolithic lining 20 and, for a little length, into a body 28*b* of synthetic material. The body 28*b* is centrally within the lining 20. Threadlike arms 32 of synthetic material (forming one piece with the body 28*b*) extend from the body 28*b* to the upper side 20*o* of the lining (bottom) 20. The coupling part 50 serves two functions: it serves as an adjustment aid during the insertion of the bottom into a melting vessel, for example a ladle or a tundish, when it is guided through a corresponding opening 40 in the metal casing of the vessel. It also serves for connecting the gas supply pipe (here: via a bayonet joint). After eroding the body 28*b* (including the arms) by heat, the gas supply is effected through the pipe 22, the coupling part 50 and the regions exposed by the body and the arms into the molten bath.

FIG. 3 shows a partial section of a steel pouring ladle 10 having an external metal casing 12, a refractory outer lining 14 arranged in front of it and an inner refractory monolithic lining 16 in the wall and bottom regions 18, 20.

A metallic gas supply pipe 22 extends at the bottom through the steel casing 12 and the outer lining 14 into the bottom region 20, which is sealed by means of a sleeve 24 from the exterior.

As shown in FIG. 3, the gas supply pipe spirals and a metallic adapter 26 connects to the free end 22*e* thereof in a gastight manner, which may be imagined as a component of the gas supply pipe 22.

The adapter 26 runs essentially perpendicularly to the outer lining 14 at the bottom and is formed cylindrically.

A body 28 (FIG. 4) is placed onto the upper free end of the adapter 26, which is constructed as follows:

The body 28 has an axially running sleeve 30 at the bottom, the inner cross section of which is equal or slightly larger as the outer cross section of the free end of the adapter 26 so that the body 28 may be placed, under form closure, via the sleeve 30 onto the adapter 26. The sleeve 30 is closed at the upper part, and several webs 32 run radially from the upper end portion thereof, which turn into a ring-shaped web 34, to which a cylindrical hollow part 36 adjoins.

The body 28 is manufactured as an injection moulded part and therefore consists of one piece.

As shown in FIG. 3, a monolithic refractory lining 16 lies upon the refractory outer lining 14, which encloses the region of the gas supply pipe 22 running above the outer lining 14, the adapter 26 and the body 28 (except its upper free end portion) on all sides. Thus the refractory mass extends both within the cylindrical hollow part 36 of the body 28 and within the region between the webs 32, 34 or around the said components. In other words: the gas purging device as comprising the gas supply pipe 22, the adapter 26 and the body 28 is integrated completely into the refractory monolithic bottom lining.

It is important that the body 28 ends with its upper free end 28*o* either at the height of the upper level 20*o* of the bottom lining 20 or projects slightly beyond this level to achieve, after eroding the body 28 (with all of the components thereof) by heat, a continuous path for the gas through the gas supply pipe 22, the adapter 26, the webs 32, 34 and the part 36 into a molten bath 40.

The size of the body 28 or the cross sections of the components are adapted depending the respective conditions of usage and the desired amount of the supplied gas.

What is claimed is:

1. In metallurgical vessels, a gas purging bottom having a monolithic refractory ceramic lining (20), having channels formed in the monolithic refractory ceramic lining (20) by chemical or physical processes, said channels being formed at their end related to an adjacent bottom (12) of the vessel for direct or indirect fluid connection to a gas supply pipe (22) and terminating at their other end within a corresponding outer layer (20*o*) of the refractory ceramic lining (20).

2. Gas purging bottom according to claim 1, wherein the refractory ceramic lining (20) is gastight outside the channels.

3. Gas purging bottom according to claim 1, wherein the channels extend over a spatially limited portion of the lining (20).

4. Gas purging bottom according to claim 1, wherein the channels extend throughout the volume of the lining (20).

5. Gas purging bottom according to claim 1, wherein the channels are formed to be directly connectable to the gas outlet end of the gas supply pipe (22).

6. Gas purging bottom according to claim 1, wherein a gas distribution member (28*b*, 42) may be disposed between the gas outlet end of the gas supply pipe (22) and corresponding ends at the gas inlets of the channels, which provides a fluid connection from the gas supply pipe (22) to the channels.

7. Gas purging bottom according to claim 6, wherein the gas distribution member (28*b*) is constituted by a cavity in the lining (20), formed by chemical or physical processes.

8. Gas purging bottom according to claim 1, wherein the channels, the cavity or the channels and the cavity are formed by chemically or thermally removing corresponding inserts (28).

9. Gas purging bottom according to claim 6, wherein the gas distribution member is formed as a gas distribution chamber (42).

10. Gas purging bottom according to claim 6, wherein the channels may be supplied with gas by a gas distribution member (42) formed at a metallic outer casing (12) of the metallurgical vessel.

11. Gas purging bottom according to claim 6, wherein the gas distribution member is constituted by a thermally stable adapter (26).

12. Gas purging bottom according to claim 11, wherein the adapter (26) is connectable to the gas outlet end of the gas supply pipe (22) and has means for attaching at least one insert (28).

13. Gas purging bottom according to claim 11, wherein the adapter (26) is formed as an integral component of the gas outlet end of the gas supply pipe (22).

14. Gas purging bottom according to claim 11, wherein the adapter (26) may be screwed, clamped or welded onto the gas outlet end of the gas supply pipe (22).

15. Gas purging bottom according to claim 11, wherein the adapter (26) has an enlarged cross section of flow, compared to the gas supply pipe (22).

16. Gas purging bottom according to claim 11, wherein at least one insert (28) is formed to be able to be placed, screwed or clamped onto the adapter (26).

17. Gas purging bottom according to claim 11, wherein the adapter (26) is formed having several gas outlet ports, and at least one insert (28) is formed having a corresponding number of webs (32, 34), each of which, in the mounting position, is associated to a gas outlet port.

18. Gas purging bottom according to claim 8, wherein at least one insert (28) is formed cylindrically.

19. Gas purging bottom according to claim 8, wherein the insert(s) is (are) constituted by several webs (32) which extend in spaced apart relationship from a common link point at the gas outlet end of the gas supply pipe (22) or from the gas distribution member through the refractory lining (20).

20. Gas purging bottom according to claim 8, wherein at least one insert (28) is constituted by several webs (32) which extend in a netlike manner from a common link point at the gas outlet end of the gas supply pipe (22) or from the gas distribution member through the refractory lining (20).

21. Gas purging bottom according to claim 8, wherein at least one insert (28) is constituted by one or more thin planar body.

22. Gas purging bottom according to claim 21, wherein the bodies have several openings arranged in spaced apart relationship.

23. Gas purging bottom according to claim 22, wherein the openings are arranged in a pattern of a chequerboard.

24. Gas purging bottom according to claim 1, wherein the gas supply pipe (22) is made of metal.

25. Gas purging bottom according to claim 11, wherein the adapter (26) is made of metal.

26. Gas purging bottom according to claim 8, wherein at least one insert (28) is made of paper, cardboard or synthetic material.

27. Gas purging bottom according to claim 8, wherein at least one insert (28) with its free end portion projects beyond the refractory lining (20).

28. Gas purging bottom according to claim 1, designed as a prefabricated element.

29. Gas purging bottom according to claim 28, having at least one coupling part (50) projecting in the direction to the adjacent bottom (12) of the vessel.

30. Gas purging bottom according to claim 29, wherein the coupling part (50) is formed at its free end for connecting to the gas supply pipe (22) and is designed as a hollow body which, at its opposite end, connects directly or indirectly to the channels.

* * * * *

UNITED STATES PATENT AND TRADEMARK OFFICE

CERTIFICATE OF CORRECTION

PATENT NO. : 6,129,889
DATED : October 10, 2000
INVENTOR(S) : Slamenik et al.

It is certified that error appears in the above-identified patent and that said Letters Patent is hereby corrected as shown below:

Title page,
In the "Foreign Application Priority Data" section, change "[GB] United Kingdom" to -- [DE] Germany --.

Signed and Sealed this

Sixth Day of November, 2001

*Attest:*

Nicholas P. Godici

*Attesting Officer*

NICHOLAS P. GODICI
*Acting Director of the United States Patent and Trademark Office*